US006495503B1

(12) United States Patent
Zappone et al.

(10) Patent No.: US 6,495,503 B1
(45) Date of Patent: Dec. 17, 2002

(54) UNIT DOSE NONAQUEOUS LIQUID SOFTENER DISPOSED IN WATER SOLUBLE CONTAINER

(75) Inventors: Marianne Zappone, Burlington, NJ (US); Charles Schramm, Jr., Hillsborough, NJ (US); Amjad Farooq, Hillsborough, NJ (US); Arthur Wagner, Roselle Park, NJ (US); Jeffrey T. Epp, Mount Arlington, NJ (US); Joseph Reul, Heusy (BE); Hoai-Chau Cao, Ans (BE); Alain Jacques, Blegny (BE); Alain Gourgue, Lincent (BE); Juliette Rousselet, Glons (BE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/209,555

(22) Filed: Jul. 31, 2002

(51) Int. Cl.[7] ..... C11D 17/00

(52) U.S. Cl. ..... 510/296; 510/297; 510/327; 510/329; 510/330; 510/334; 510/391; 510/439; 510/510; 510/515

(58) Field of Search ..... 510/296, 297, 510/327, 329, 334, 391, 439, 501, 515, 330

(56) References Cited

U.S. PATENT DOCUMENTS

| | | | | | |
|---|---|---|---|---|---|
| 4,203,851 | A | * | 5/1980 | Ramachandran | 252/8.6 |
| 4,259,217 | A | * | 3/1981 | Murphy | 252/547 |
| 4,818,421 | A | * | 4/1989 | Boris et al. | 252/8.8 |
| 5,089,148 | A | * | 2/1992 | Van Blarcom et al. | 252/8.6 |
| 5,183,580 | A | * | 2/1993 | Lew et al. | 252/8.6 |
| 5,770,557 | A | * | 6/1998 | Bruhnke | 510/515 |
| 5,972,870 | A | * | 10/1999 | Anderson | 510/298 |

* cited by examiner

*Primary Examiner*—Necholus Ogden
(74) *Attorney, Agent, or Firm*—RIchard E. Nanfeldt

(57) ABSTRACT

A water soluble container having disposed therein a non-aqueous liquid fabric softener composition.

5 Claims, No Drawings

UNIT DOSE NONAQUEOUS LIQUID SOFTENER DISPOSED IN WATER SOLUBLE CONTAINER

FIELD OF THE INVENTION

This invention relates to unit dose laundry compositions for softening or conditioning fabrics. More particularly, this invention relates to unit dose liquid fabric softening compositions, which is contained in a water-soluble container suitable for use in an automatic washing machine.

BACKGROUND OF THE INVENTION

Detergent compositions manufactured in the form of compacted detergent powder are known in the art. U.S. Pat. No. 5,225,100, for example, describes a tablet of compacted powder comprising an anionic detergent compound, which will adequately disperse in the wash water.

Although detergent compositions in the form of compacted granular tablets of various shapes have received much attention in the patent literature, the use of such tablets to provide a unit dose fabric softener which will soften or condition fabrics in the wash cycle without impairing detergency or otherwise compromise the cleaning benefits provided by the detergent composition is not known.

Laundry detergent compositions which further include a fabric softener to provide softening or conditioning of fabrics in the wash cycle of the laundering operation are well-known in the art and described in the patent literature. See, for example, U.S. Pat. No. 4,605,506 to Wixon; U.S. Pat. No. 4,818,421 to Boris et al. and U.S. Pat. No. 4,569,773 to Ramachandran et al., all assigned to Colgate-Palmolive Co., and U.S. Pat. No. 4,851,138 assigned to Akzo. U.S. Pat. No. 5,972,870 to Anderson describes a multi-layered laundry tablet for washing which may include a detergent in the outer layer and a fabric softener, or water softener or fragrance in the inner layer. But, these type of multi-benefit products suffer from a common drawback, namely, there is an inherent compromise which the user necessarily makes between the cleaning and softening benefits provided by such products as compared to using a separate detergent composition solely for cleaning in the wash cycle and a separate softening composition solely for softening in the rinse cycle. In essence, the user of such detergent softener compositions does not have the ability to independently adjust the amount of detergent and softener added to the wash cycle of a machine in response to the cleaning and softening requirements of the particular wash load.

Some attempts have been made in the art to develop wash cycle active fabric softeners, typically in powder form. But, these type products are characterized by the same inconvenience inherent with the use of powered detergents, namely, problems of handling, caking in the container or wash cycle dispenser, and the need for a dosing device to deliver the desired amount of active softener material to the wash water.

The use of a unit dose fabric softening composition contained in a water soluble container such as a sachet offers numerous advantages. To be effective, the unit dose fabric softening compositions, contained in a sachet, must be able to disperse in the wash liquor in a short period of time to avoid any residue at the end of the wash cycle.

Typically, the wash cycle time can be as short as 12 minutes and as long as 90 minutes (in typical European washers) depending on the type of washer and the wash conditions. Therefore, the water-soluble sachet must be soluble in the wash liquor before the end of the cycle.

SUMMARY OF THE INVENTION

The present invention provides a unit dose fabric softening composition contained in a water soluble container for softening or conditioning fabrics in an automatic washing machine, said unit dose comprising (a) a wash soluble container; and (b) disposed in the water soluble container is a nonaqueous liquid fabric softener composition, the amount of composition being sufficient to form a unit dose capable of providing effective softening or conditioning of fabrics in said washing machine.

The term "fabric softener" is used herein for purposes of convenience to refer to materials which provide softening and/or conditioning benefits to fabrics in a home or automatic laundering machine.

The fabric softener composition of the invention is preferably comprised of one or more fabric softening agents, optionally a dispersing agent, and optionally a perfume.

In accordance with the process aspect of the invention there is provided a process for softening or conditioning laundry which comprises contacting the laundry with an effective amount of the unit dose laundry composition defined above.

DETAILED DESCRIPTION OF THE INVENTION

The present invention relates to a water soluble sachet containing a unit dose of a fabric softener composition, wherein the water soluble sachet is formed from a single layer of water soluble thermo plastic film such as a polyvinyl alcohol, wherein the inner surface of the film is in contact with the fabric softener composition and the external surface of the film does not have a water soluble glue disposed thereon.

The nonaqueous liquid fabric softener composition contained in the water soluble sachet comprises:

(a) 25% to 65%, more preferably 30% to 60% of at least one amido-amine fabric softening agent;

(b) 0.1% to 12%, more preferably 0.5% to 10% of at least one dispersing agent;

(c) 10% to 35% of at least one aliphatic acid having about 6 to about 12 carbon atoms; and (d) 10% to 50%, more preferably 15% to 45% of an oil with a carbon chain length from C5–C20.

The composition can optionally contain a perfume at a concentration of 0 to 12%, more preferably 0.5% to 10%.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to softening performance so long as it meets the criteria of water immiscibility and having a pleasing odor. Naturally, of course, especially for softening compositions intended for use in the home, the perfume, as well as all other ingredients, should be cosmetically acceptable, i.e., non-toxic, hypoallergenic, etc.

The fabric softening active compound is an amidoamine of formula (I):

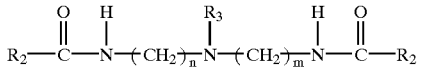

(I)

In the above formula $R_1$ and $R_2$ are each, independently, long chain alkyl or alkenyl groups having from 8 to 22 carbon atoms, preferably from 10 to 18 carbon atoms, such as, for example, octyl, octenyl, decyl, decenyl, dodecyl, dodecenyl, octadecyl, octadecenyl. Typically, $R_1$ and $R_2$, and more generally $R_1$—CO and $R_2$—CO, will be derived from natural oils containing fatty acids or fatty acid mixtures, such as coconut oil, palm oil, tallow, rape oil and fish oil. Chemically synthesized fatty acids are also usable. The saturated fatty acids or fatty acid mixtures, and especially hydrogenated tallow (H-tallow) acid (also referred to as hard tallow), are preferred. Generally and preferably $R_1$ and $R_2$ are derived from the same fatty acid or fatty acid mixture.

$R_3$ represents $(CH_2CH_2O)pH$, $CH_3$ or H, or mixtures thereof may also be present. When $R_3$ represents the preferred $(CH_2CH_2O)pH$ group, p is a positive number representing the average degree of ethoxylation, and is preferably from 1 to 10, especially 1.5 to 6, and most preferably from about 2 to 4, such as 2.5 n and m are each integers of from 1 to 5, preferably 2 to 4, especially 2. The compounds of formula (I) in which $R_3$ represents the preferred $(CH_2CH_2O)$ pH group are broadly referred to herein as ethoxylated amidoamines, and the term "hydroxyethyl" is also used to describe the $(CH_2CH_2O)pH$ group.

One especially preferred is the compound of formula (I) which is commercially available is Varisoft™ 510, available from Sherex Chemical Company, which is bis(hydrogenated tallow-amidoethyl)-hydroxyethyl amine of formula:

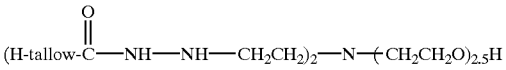

Another especially preferred fabric softening active compound is Adogen™ 343 available from Degussa, Goldschmidt Textile Care which is a bis(hydrogenated tallow-amidoethyl)-methyl amine.

An especially preferred composition consists of a mixture of Varisoft 510 and Adogen 343 in a weight ratio of 1.5:1 to 1:0.75.

In place of the Varisoft 510, or in combination therewith, the corresponding soft (non-hydrogenated) tallow derivative, available from Sherex as Varisoft 512, may be used. Varisoft 512 is ethoxylated with 3.5 moles, on average, rather than 2.5 moles EO as in Varisoft 510. The softening performance of the hard tallow derivative is somewhat better than that of the soft tallow. It has been found that when Varisoft 510 and Varisoft 512 are used in admixture, preferably at ratios of about 10:1 to about 1.5:1, preferably from 8:1 to 2:1, especially 6:1 to 3:1, both softening performance and stability are improved.

The aliphatic acid having about 6 to about 12 carbon atoms is selected from the group consisting of neoheptanoic acid, neononanoic acid, neodecanoic acid, isooctanoic acid, and isononanoic acid, isodecanoic acid, heptanoic acid, octanoic acid, nonanoic acid, decanoic acid, undecanoic acid, dodecanoic acid, isododecanoic acid, isohexanoic acid, hexanoic acid, isoundecanoic acid, and mixtures thereof.

The oil can be derived from either natural or petroleum based sources. Preferred oils contain alkyl or alkenyl groups consisting of 14 to 20 carbon atoms per alkyl group. The natural oils are typically esters of fatty acids and glycerol. Some examples of preferred oils include, but are not limited to, corn oil, safflower seed oil, sunflower seed oil, olive oil, soybean oil, cottonseed oil, and linseed oil. Additionally, petroleum based oils are most preferred due to low incidence of odor and hydrogenation over time. Petroleum based oils that are most preferred include mineral oil (linear and cyclic paraffinic hydrocarbon distribution with a boiling point of 240 F.–300 F.).

The dispersing agent used in the instant nonaqueous liquid fabric softening composition are selected from the group consisting of glycereth cocoate, oleate PEG200, Dioleate PEG400, 4000 MW polyethylene dioleate and ethoxylated nonionic surfactants formed from the reaction of one mole of a $C_{12-13}$ fatty alcohol and 2 to 4 moles of ethylene oxide and mixtures thereof.

The water soluble container which can be in the form of a sachet, a blow molded capsule or other blow molded shapes, an injected molded ampoule or other injection molded shapes, or rotationally molded spheres or capsules are formed from a water soluble thermoplastic resin. Water soluble plastics which may be considered for forming the container include low molecular weight and/or chemically modified polylactides; such polymers have been produced by Chronopol, Inc. and sold under the Heplon trademark. Also included in the water soluble polymer family are melt processable poly(vinyl) alcohol resins (PVA); such resins are produced by Texas Polymer Services, Inc., tradenamed Vinex, and are produced under license from Air Products and Chemicals, Inc. and Monosol film produced by Monosol LLC. Other suitable resins include poly (ethylene oxide) and cellulose derived water soluble carbohydrates. The former are produced by Union Carbide, Inc. and sold under the tradename Polyox; the latter are produced by Dow Chemical, Inc. and sold under the Methocel trademark. Typically, the cellulose derived water soluble polymers are not readily melt processable. The preferred water soluble thermoplastic resin for this application is PVA produced by Monosol LLC. Any number or combination of PVA resins can be used. The preferred grade, considering resin processability, container durability, water solubility characteristics, and commercial viability is Monosol film having a weight average molecular weight range of about 55,000 to 65,000 and a number average molecular weight range of about 27,000 to 33,000.

The sachet may be formed from poly(vinyl) alcohol film. The pelletized, pre-dried, melt processable polyvinyl alcohol (PVA) resin, is feed to a film extruder. The feed material may also contain pre-dried color concentrate which uses a PVA carrier resin. Other additives, similarly prepared, such as antioxidants, UV stabilizers, anti-blocking additives, etc. may also be added to the extruder. The resin and concentrate are melt blended in the extruder. The extruder die may consist of a circular die for producing blown film or a coat hanger die for producing cast film. Circular dies may have rotating die lips and/or mandrels to modify visual appearance and/or properties. Alternatively, the PVA resins can also be dissolved and formed into film through a solution-casting process, wherein the PVA resin or resins are dissolved and mixed in an aqueous solution along with additives. This solution is cast through a coat hanger die, or in front of a doctor blade or through a casting box to produce a layer of solution of consistent thickness. This layer of solution is cast or coated onto a drum or casting band or appropriate substrate to convey it through an oven or series of ovens to reduce the moisture content to an appropriate level. The extruded or cast film is slit to the appropriate width and wound on cores. Each core holds one reel of film.

Typical film properties are:

1. Tensile strength (125 mil, break, 50% RH)=4,700 to 5,700 psi
2. Tensile modulus (125 mil, 50% RH)=47,000 to 243,000 psi; preferred range is 140,000 to 150,000 psi
3. Tear resistance (mean) (ASTM-D-199 gm/ml)=900–1500
4. Impact strength (mean) (ASTM-D-1709, gm)=600–1,000
5. 100% Elongation (mean) (ASTM-D-882, psi)=300–600
6. Oygen transmission (1.5 mil, 0% RH, 1 atm)=0.0350 to 0.450 cc/100 sq. in./24 h
7. Oxygen transmission (1.5 mil, 50% RH, 1 atm)=1.20 to 1.50 cc/100 sq. in./24 h
8. 100% modulus (mean) (ASTM-D-882, psi)=1000–3000
9. Solubility (sec) (MSTM-205,75° F.) disintegration=1–15; dissolution=10–30

Typical resin properties are:

1. Glass Transition Temperature (°C.)=28 to 38; preferred is 28 to 33,
2. Weight Average Molecular Weight (Mw)=15,000 to 95,000; preferred is 55,000–65,000
3. Number Average Molecular Weight (Mn)=7,500 to 60,000; preferred is 27,000 to 33,000. Preferred poly (vinyl) alcohol film is formed from Monosol 7030 or Monosol 8630

Reels of slit film are fed to a form, fill, seal machine (FFS). The Form, Fill, Seal machine (FFS) makes the appropriate sachet shape (cylinder, square, pillow, oval, etc.) from the film, fills the sachet with product, and seals the sachet.

There are many types of form fill seal machines that can convert water soluble films, including vertical, horizontal and rotary machines. To make the appropriate sachet shape, one or multiple films can be used. The sachet shape can be folded into the film, mechanically deformed into the film, or thermally deformed into the film. The sachet forming can also utilize thermal bonding of multiple layers of film, or solvent bonding of multiple layers of film. When using poly(vinyl) alcohol the most common solvent is water. Once the appropriately shaped sachet is filled with product, the sachet can be sealed using either thermal bonding of the film, or solvent bonding of the film.

Blow molded capsules are formed from the poly(vinyl) alcohol resin having a molecular weight of about 50,000 to about 70,000 and a glass transition temperature of about 28 to 33° C. Pelletized resin and concentrate(s) are feed into an extruder. The extruder into which they are fed has a circular, oval, square or rectangular die and an appropriate mandrel. The molten polymer mass exits the die and assumes the shape of the die/mandrel combination. Air is blown into the interior volume of the extrudate (parison) while the extrudate contacts a pair of split molds. The molds control the final shape of the package. While in the mold, the package is filled with the appropriate volume of liquid. The mold quenches the plastic. The liquid is contained within the interior volume of the blow molded package.

An injection molded ampoule or capsule is formed from the poly(vinyl) alcohol resin having a molecular weight of about 50,000 to about 70,000 and a glass transition temperature of about 28 to 38° C. Pelletized resin and concentrate(s) are fed to the throat of an reciprocating screw, injection molding machine. The rotation of the screw pushes the pelletized mass forward while the increasing diameter of the screw compresses the pellets and forces them to contact the machine's heated barrel. The combination of heat, conducted to the pellets by the barrel and frictional heat, generated by the contact of the pellets with the rotating screw, melts the pellets as they are pushed forward. The molten polymer mass collects in front of the screw as the screw rotates and begins to retract to the rear of the machine. At the appropriate time, the screw moves forward forcing the melt through the nozzle at the tip of the machine and into a mold or hot runner system which feeds several molds. The molds control the shape of the finished package. The package may be filled with liquid either while in the mold or after ejection from the mold. The filling port of the package is heat sealed after filling is completed. This process may be conducted either in-line or off-line.

A rotationally molded sphere or capsule is formed from the poly(vinyl) alcohol resin having a molecular weight of about 50,000 to about 70,000 and a glass transition temperature of about 28 to 38° C. Pelletized resin and concentrate are pulverized to an appropriate mesh size, typically 35 mesh. A specific weight of the pulverized resin is fed to a cold mold having the desired shape and volume. The mold is sealed and heated while simultaneously rotating in three directions. The powder melts and coats the entire inside surface of the mold. While continuously rotating, the mold is cooled so that the resin solidifies into a shape which replicates the size and texture of the mold. After rejection of the finished package, the liquid is injected into the hollow package using a heated needle or probe after filling, the injection port of the package is heat sealed.

Typical unit dose compositions for use herein may vary from about 5 to about 20 ml corresponding on a weight basis to about 5 to about 20 grams (which includes the weight of the capsule).

The following examples illustrate liquid fabric softening compositions of the described invention. Unless otherwise specified, the proportions in the film and elsewhere in the specification are by weight.

EXAMPLE 1

The purpose of this example is to show that a nonaqueous liquid fabric softener can be delivered in the wash cycle via a water-soluble film sachet, and provide a softening benefit on the clothes. Nonaqueous wash cycle fabric softeners of the compositions listed in Table 1 were prepared:

| Ingredient | 1 Wt. % | 2 Wt. % |
|---|---|---|
| Adogen 343 | 52 | 36 |
| Neoheptanoic acid | 25 | 17 |
| Mineral oil | 20 | 42 |
| 4000 MW polyethylene dioleate | 3.1 | 3.1 |

The samples were prepared by heating the amine to 80C with stirring and slowly adding each of the other ingredients in order while heating and mixing. The composition was then allowed to cool with mixing. A yellow liquid resulted.

The compositions were then injected into sachets composed of 3 mil thick polyvinylalcohol (PVA) film, which was then heat sealed. Each sachet contained 15 grams of the particular composition.

The efficacy of the compositions was evaluated via a standard softening test. Cotton terry hand towels are prepared by washing repeatedly in hot water with a nonionic based detergent to artificially harshen them. Four towels are then washed for each product under US wash conditions (77F, ~80 ppm water hardness, 17 gallon top loading washing machines, 80 g Tide SCHDD) with a 6.5 lb ballast load of clothes. Three cells were compared: 1) no softener added to the wash cycle; 2) one 15 g sachet of Sample 1 added at the beginning of the wash cycle; and 3) one 15 g sachet of Sample 2 added at the beginning of the wash cycle. Nothing was added to the rinse cycle for any of the cells. The towels were then dried in an electric dryer for 30 minutes and allowed to equilibrate in a constant humidity environment for 24 hours. After 24 hours, the towels were ranked from harshest to softest by a twenty member panel. The data was then evaluated via a Friedman's test analysis. The results are as follows:

| | Control (no softener in wash) | Sample 1 in wash | Sample 2 in wash |
|---|---|---|---|
| Score (lower values is softer) | 75 | 52 | 53 |
| Result at 90% confidence level | Harsher than Samples 1 and 2 | Parity to Sample 2; Softer than control | Parity to Sample 1; Softer than control |

The results show that both Samples 1 and 2 provide a softening benefit to clothes when added to the wash cycle via a water soluble sachet.

What is claimed is:

1. A softening system which comprises:

(a) a water soluble container which is formed from a polyvinyl alcohol; and (b) a liquid fabric softener composition disposed in said water soluble container, wherein said fabric softener composition comprises 25% to 65% of at least one softening compound which is an amido-amine softening agent;

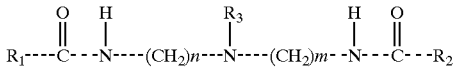

Wherein $R_1$ and $R_2$ are each independently long chain alkyl or alkenyl groups having 8 to 22 carbon atoms, $R_3$ is selected from the group consisting of $(CH_2CH_2O)_p$ H, $CH_3$ and H and mixtures thereof, p is an integer from 1 to 10 and m and n are integers from 1 to 5; and (C) 0.5 wt % to 10 wt % of at least one dispersing aid selected from the group consisting of glycereth cocoate, oleate PEG200, dioleate PEG400, and a $C_{12}$–$C_{13}$EO3:1 ethoxylated fatty alcohol and mixtures thereof.

2. The system according to claim 1 wherein said container is a sachet, ampoule, capsule or sphere.

3. The system according to claim 1 further including an oil.

4. The system according to claim 3 further wherein said oil is selected from the group consisting of mineral oil, safflower oil, linseed oil, sunflower oil, and assorted esters of glycerol with alkyl and alkenyl groups of 14 to 20 carbon atoms and mixtures thereof.

5. The system according to claim 3 further including 0.5 wt. % to 6 wt. % of a perfume.

* * * * *